US007441482B2

(12) United States Patent
Lin

(10) Patent No.: US 7,441,482 B2
(45) **Date of Patent: *Oct. 28, 2008**

(54) QUICK SWITCHING HAND TOOL

(76) Inventor: Tsung-Da Lin, 235 Chung-Ho Box 8-24, Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/937,490

(22) Filed: Nov. 8, 2007

(65) Prior Publication Data

US 2008/0110300 A1 May 15, 2008

Related U.S. Application Data

(62) Division of application No. 11/598,272, filed on Nov. 13, 2006.

(51) Int. Cl.
*B25B 13/46* (2006.01)

(52) U.S. Cl. ..... 81/62; 81/177.85

(58) Field of Classification Search ..... 81/61–63.2, 81/177.85

See application file for complete search history.

(56) References Cited

U.S. PATENT DOCUMENTS

| | | | | | |
|---|---|---|---|---|---|
| 3,575,069 | A * | 4/1971 | White | ..... | 81/58.1 |
| 4,762,032 | A * | 8/1988 | Chow | ..... | 81/63 |
| 4,765,449 | A * | 8/1988 | Peters | ..... | 192/43.1 |
| 5,174,176 | A * | 12/1992 | Krivec | ..... | 81/63.1 |
| 5,501,124 | A * | 3/1996 | Ashby | ..... | 81/58.2 |

* cited by examiner

*Primary Examiner*—D. S Meislin

(57) ABSTRACT

A quick switching hand tool comprises a driving head having a ratchet teeth portion; a control device having a control rod; the control rod being installed with a driving block which is interacted with a buckle unit; and the buckle unit is engageable to the ratchet teeth portion. When the control rod is pressed, the control rod will drive the driving block to rotate so that the buckle unit shifts with the driving block so as to switch the restoring direction of the driving head. Furthermore, in another design, the buckle unit has two buckle teeth blocks. Each buckle teeth block is pivotally installed to the driving head and the buckle unit is engageable to the ratchet teeth portion; an outer end of the driving block has an resisting rib for controlling positions of the buckle teeth block.

5 Claims, 8 Drawing Sheets

QUICK SWITCHING HAND TOOL

The present invention is a division application of U.S. patent Ser. No. 11/598,272 filed Nov. 13, 2006, which is assigned to and invented by the inventor of the present invention, and thus the contents of the U.S. patent Ser. No. 11/598,272 is incorporated into the present invention as a part of the present invention.

The present invention claims the features in FIGS. 7 to 10 of the present invention.

FIELD OF THE INVENTION

The present invention relates to spanners, and particularly to a quick switching hand tool, wherein the switching of the ratchet teeth portion can be operated easily and conveniently, while only a small space is necessary in operation.

BACKGROUND OF THE INVENTION

A ratchet spanner has a driving head. In the driving head, a ratchet teeth portion is engaged to a buckle unit so that the ratchet teeth portion can restore bidirectionally. Thus the user can drive the spanner again. When the user needs to drive the spanner along an opposite direction, a switch is used to change the driving direction of the ratchet teeth portion.

In one prior art, a switch is installed aside the driving head and the switch can be adjusted bidirectionally so as to adjust the restore direction of the driving head.

However the prior art switch occupies a great space for switching bidirectionally and restoring. As a result, the area of the ratchet teeth portion is increased and thus the driving head cannot be operated smoothly.

Moreover, the prior art is a ratchet sleeve spanner which has a release switch. The release switch is pressable. When the release switch is pressed, a positioning ball at a front end of the spanner will induce inwards for taking down the sleeve.

Thus two different switches are used and thus the user must take time to determine which switch will be used. Further, only one switch can be operated each time and thus the use of the spanner is inconvenient. Moreover, this induces inconvenience in manufacturing.

SUMMARY OF THE INVENTION

Accordingly, the primary object of the present invention is to provide a quick switching hand tool, wherein the switching of the ratchet teeth portion can be operated easily and conveniently, while only a small space is necessary in operation.

To achieve above objects, the present invention provides a quick switching hand tool comprising a driving head having a ratchet teeth portion; a control device having a control rod; the control rod being installed with a driving block which is interacted with a buckle unit; the buckle unit is engageable to the ratchet teeth portion. When the control rod is pressed, the control rod will drive the driving block to rotate so that the buckle unit shifts with the driving block so as to switch restoring direction of the driving head. Furthermore, in another design, the buckle unit has two buckle teeth blocks. Each buckle teeth block is pivotally installed to the driving head and the buckle unit is engageable to the ratchet teeth portion; an outer end of the driving block has an resisting rib for controlling positions of the buckle teeth block.

The various objects and advantages of the present invention will be more readily understood from the following detailed description when read in conjunction with the appended drawing.

BRIEF DESCRIPTION OF THE DRAWINGS

FIGS. 4-1 to 6-1 are schematic view showing that the driving block in FIG. 4 to 6 is driven by the interaction units according to the present invention.

DETAILED DESCRIPTION OF THE INVENTION

Figure 1:
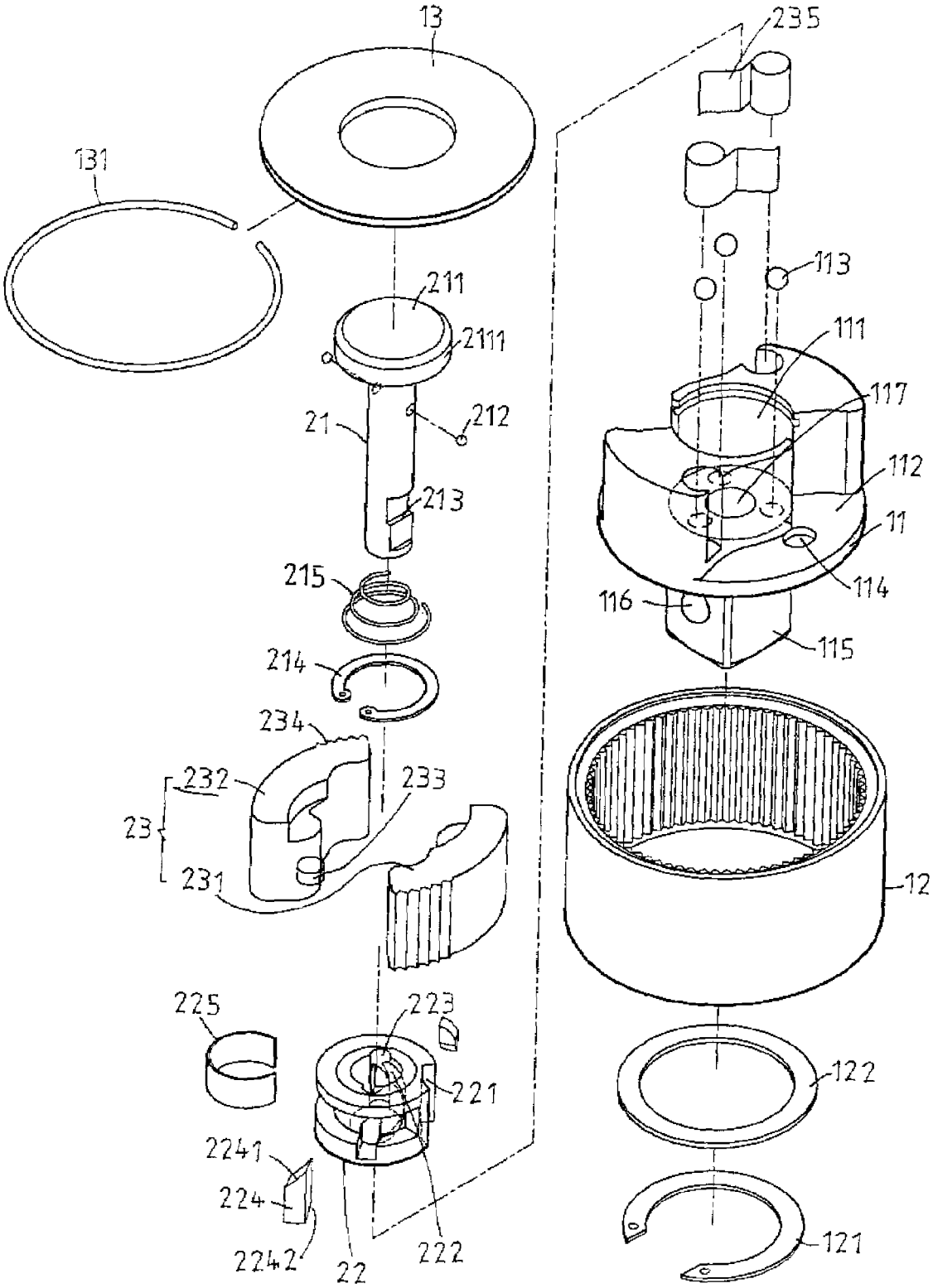
FIG. 1 is an exploded perspective view of the quick switching hand tool of the present invention.
Figure 2:
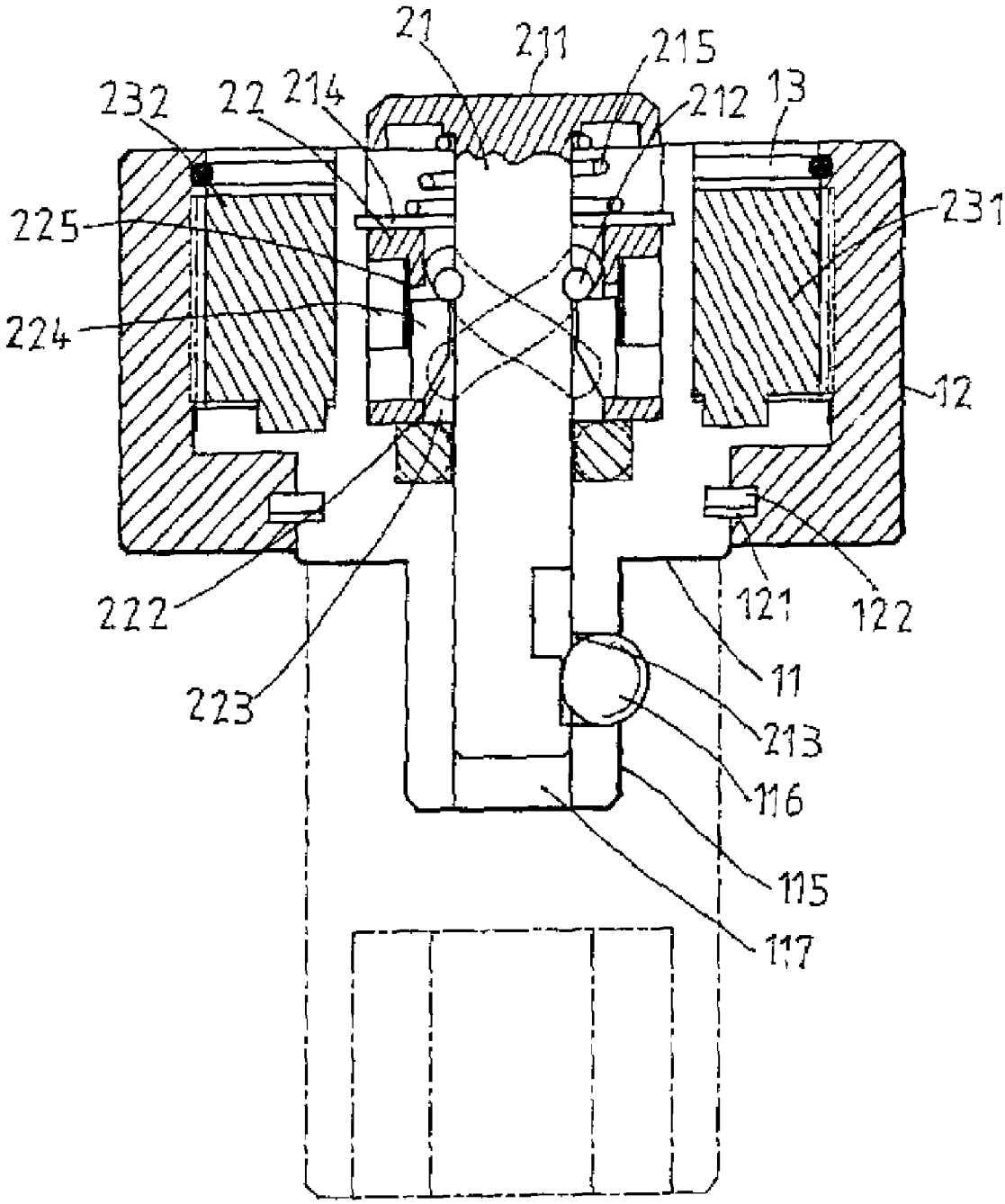
FIG. 2 is a schematic cross sectional view of the quick switching hand tool of the present invention.

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 4, the quick switching hand tool of the present invention is illustrated. The present invention has the following elements.

A driving head has a seat. The seat 11 is engaged to the ratchet teeth portion 12 for receiving a control device. A center of the seat 11 has a main space 111 and two lateral spaces 112 aside the main space 111. Each lateral space 112 is communicated to the main space 111. A bottom of the main space 111 is embedded with a plurality of balls 113. Each lateral space 112 has a pivotal groove 114. A lower side of the seat 11 is extended with a head end 115. The head end 115 is installed with a steel ball 116 as a positioning body 116. A bottom of the main space 111 has a through hole 117 which is communicated to the positioning body 116 of the head end 115.

The ratchet teeth portion 12 is annularly installed with a plurality of teeth. The ratchet teeth portion 12 is combined to the seat 11 by using a C ring and a washer 122. The ratchet teeth portion 12 encloses the seat 11 and is rotatable with respect to the seat 11.

The outer cover 13 is used to seal a driving head through a C ring 131 so as to position the elements of the seat 11.

A control device includes a control rod 21, a driving block 22 and a buckle unit 23.

A top of the control rod 21 is formed with a press head 211 with a greater diameter than other portion of the control rod 21. A stop edge 2111 extends downwards from the press head 211. Two interaction units 212 are embedded into the control rod 21 and at two ends of a diameter of the rod body of the control rod 21. One lower end of the control rod 21 is formed with a stepped driving portion 213. The control rod 21 is installed within the main space 111 of the seat 11 by using a C ring 214. An elastic body 215 encloses the body of the control rod 21 and is between the positioning body 116 and the C ring 214. The ratchet teeth portion 12 and the stop edge 2111 shield the elastic body 215 so as not to expose out. The driving portion 213 of the control rod 21 enters into the through hole 17 to interact with the positioning body 116 of the head end 115.

Figures 1, 6:
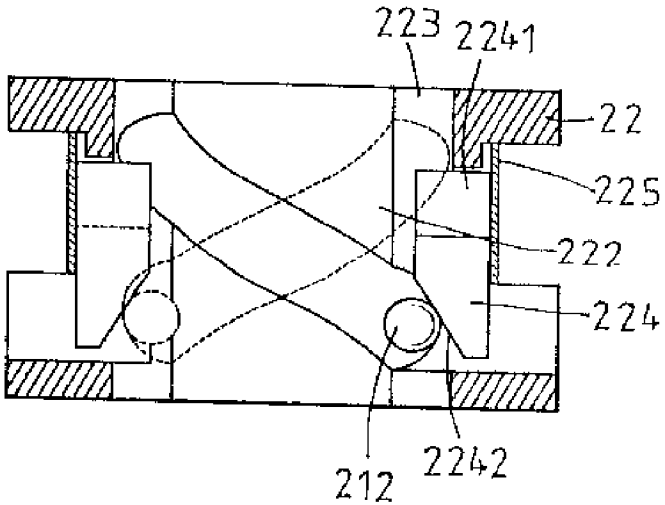
Figure 6:
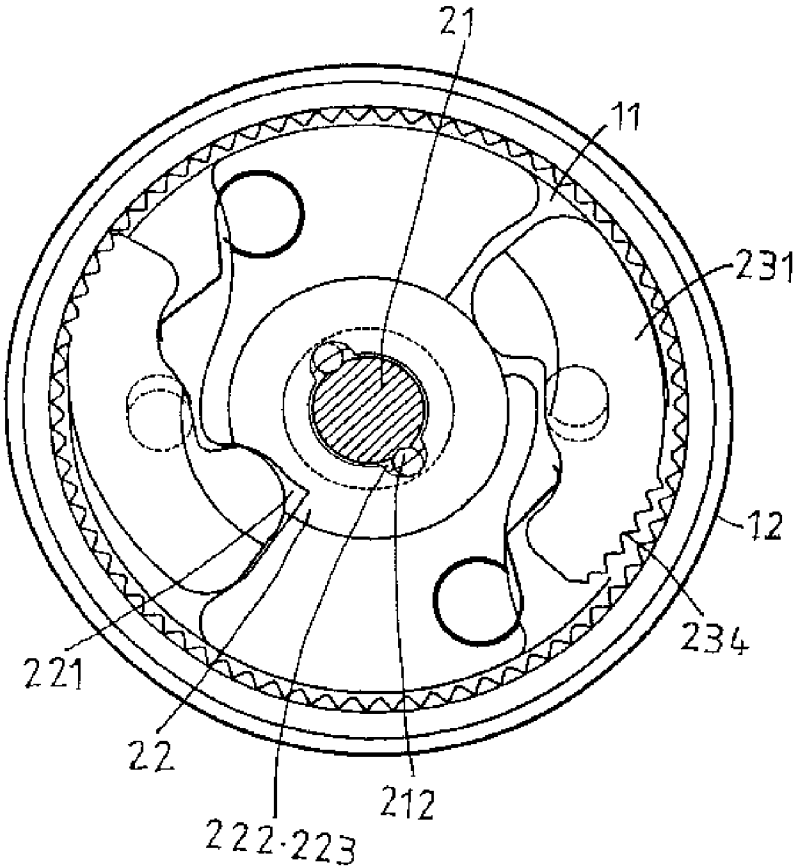
Figure 7:
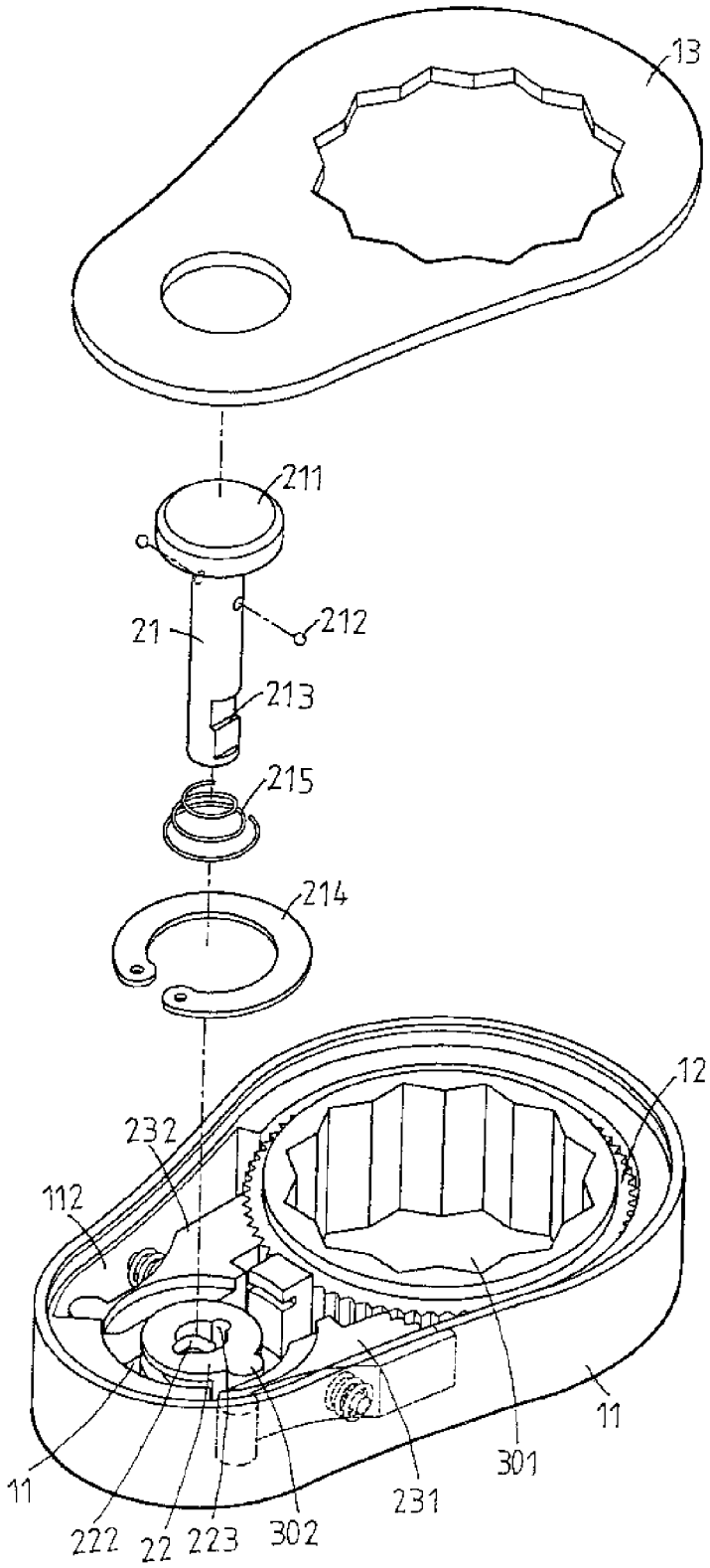
FIG. 7 shows the second embodiment of the present invention.
Figure 8:
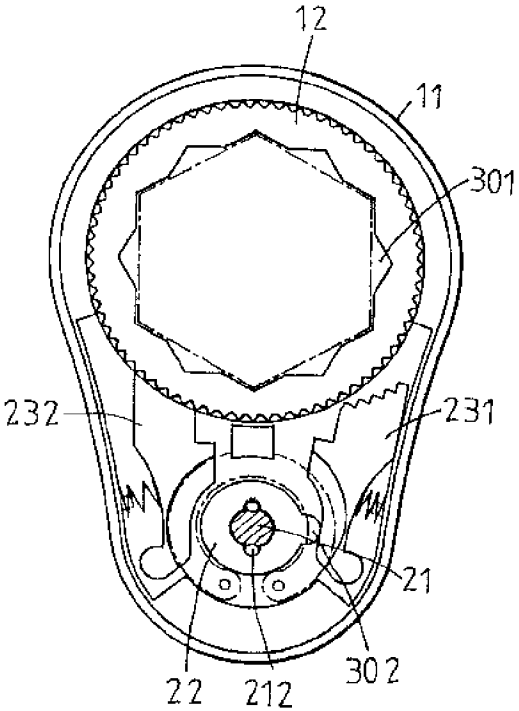

The driving block 22 is a hollow short round cylinder and is engaged to the control rod 21. An outer side of the driving block 22 is formed with a recess 221 for interacting with the buckle unit 23. An inner side of the driving block 22 is formed with two inclined cambered trenches 222. Each trench 22 extends from an upper end of the driving block 22 and then extends through 180 degrees to a lower end of the driving block 22. The upper ends of two trenches 222 are communicated by a stand groove 223 and lower ends of the two trenches are communicated by another stand groove 223 (the details are illustrated in FIGS. 6 to 8). Each stand groove 223 is formed with a check block 224 which is buckled to an elastic sheet 225 at an outer side of the driving block 22. A top of each check block 224 is formed with a first inclined surface 2241 which is matched to a track of the trench 222. A lower end of each check block 224 is formed with a second inclined surface 2242 matched to the track of the trench 223. The trenches 222 and the stand grooves 223 are used in the operations of the interaction units 212 of the control rod 21.

The buckle unit 23 includes two buckle teeth blocks 231, 232 and a pivotal shaft 233 so as to be pivotally installed to the pivotal groove 114 of the seat 11. The two buckle teeth blocks 231, 232 are positioned at the two lateral spaces 112 of the seat 11. Each of the buckle teeth blocks 231, 232 is formed with a teeth section 234 for engaging to the ratchet teeth portion 12. Each buckle teeth block resists against a respective elastic unit 235. When any of the buckle teeth blocks 231, 232 is aligned to the recess 221 of the driving block 22, the buckle teeth block will be shifted to be engaged to the ratchet teeth portion 12.

Figure 3:
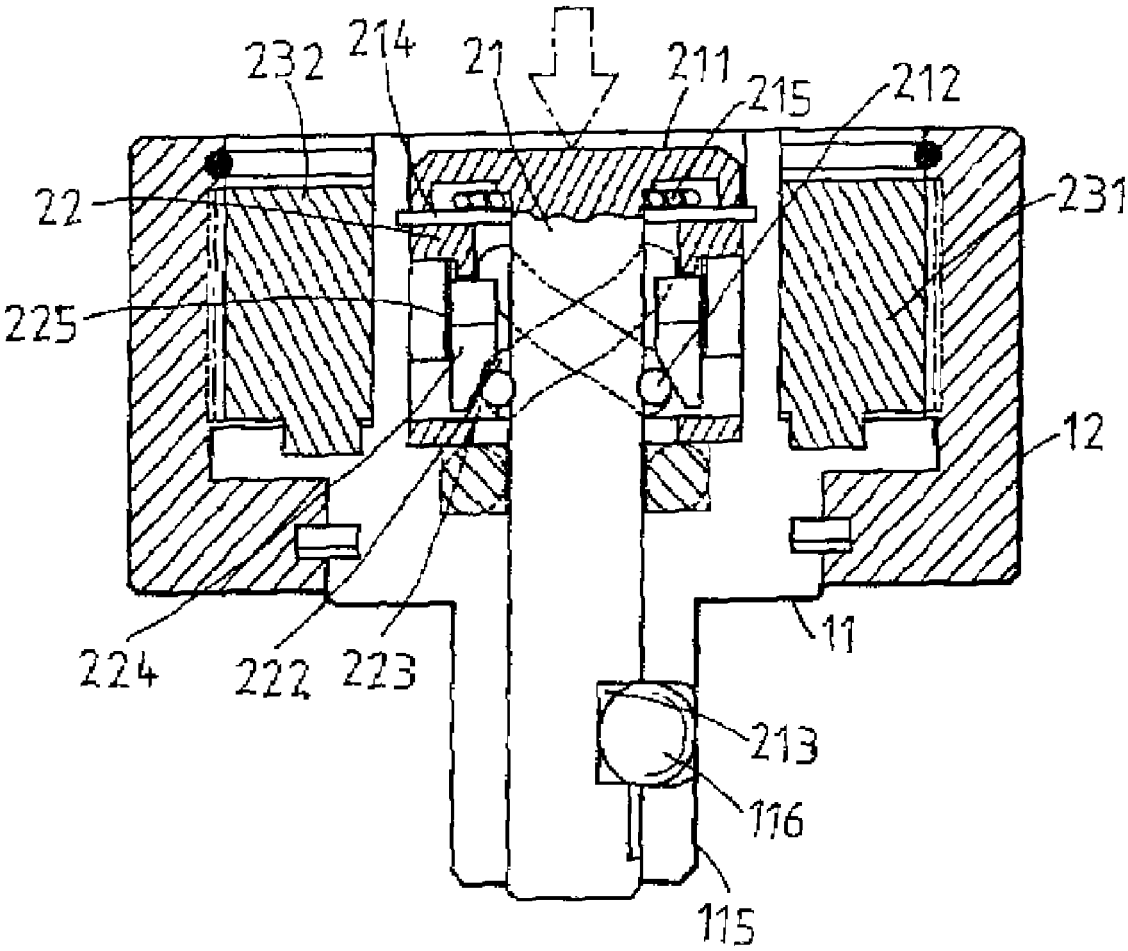
FIG. 3 is a schematic cross sectional view showing a pressing state of the quick switching hand tool according to the present invention.

In assembly of the present invention, the buckle teeth blocks 231, 232 of the buckle unit 23 are installed to the two lateral spaces 112 of the seat 11 by the matching of the pivotal shaft 233 and the pivotal groove 114. The elastic units 235 are installed between the seat 11 and the two buckle teeth blocks 231, 232, respectively so that the buckle teeth blocks 231, 232 resist against the elastic units 235. Then the check blocks 224 are placed into the stand grooves 223 of the driving block 22. The elastic sheets 225 serve to position the check blocks 223. Then the driving block 22 is placed into the main space 111 of the seat 11. The driving block 22 is rotatable with respect to the seat 11 by locating the balls 113 at the bottom side of the main space 111. Then the C ring 214 is buckled at the outer side of the main space 111 of the seat 11. Then the control rod 21 installed with the elastic body 215 is inserted into the C ring 214, driving block 22 and the through hole 117 so as to position the control rod 21. The interaction units 212 of the control rod 21 are located in the inclined trenches 222. The driving portion 213 of the control rod 21 is combined to and interacted with the positioning body 116. The seat 11 is positioned to the ratchet teeth portion 12 by using the C ring 121. Then the cover 13 enclosed by the C ring 131 covers upon an upper end of the buckle unit 23. Thus the assembly of the present invention is complete. For the assembly control device, the press head 211 of the control rod 21 exposes out. Referring to FIG. 3, when the press head 211 is pressed, the interaction units 212 will move vertically with the control rod 21. The driving block 22 will rotate due to the two trenches 222 being driven by the two interaction units 212. Then the driving block 22 is driven to enter into the recess 221. When the buckle teeth block 231 is aligned to the recess 221, the buckle teeth block 231 is pushed by the elastic unit 235 so as to be engaged to the ratchet teeth portion 12. The tool can drive a screw unit counterclockwise and it can restore clockwise. On the contrary, when the control rod 21 is pressed so that the driving block 22 rotates until the recess 221 is aligned to the buckle teeth block 232, the buckle teeth block 232 is pushed by the elastic unit 235 so as to be engaged to the ratchet teeth portion 12. Thus the tool can drive a screw unit clockwise and it can restore counterclockwise. Furthermore, in pressing the press head 211, the lower portion of the driving block 22 can contact the positioning body 116 of the head end 115 so that the positioning body 116 reduces inwards so that the object installed to the head end 115 can be pulled out conveniently.

Figures 1, 4:
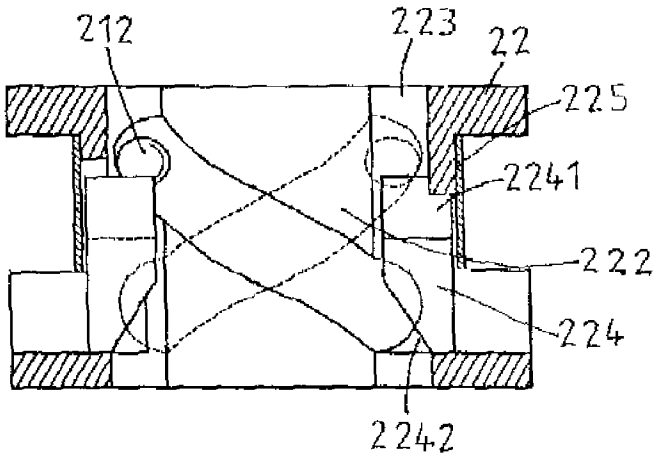
FIGS. 4 to 6 are schematic view showing the switching process of the quick switching hand tool according to the present invention.
Figure 4:
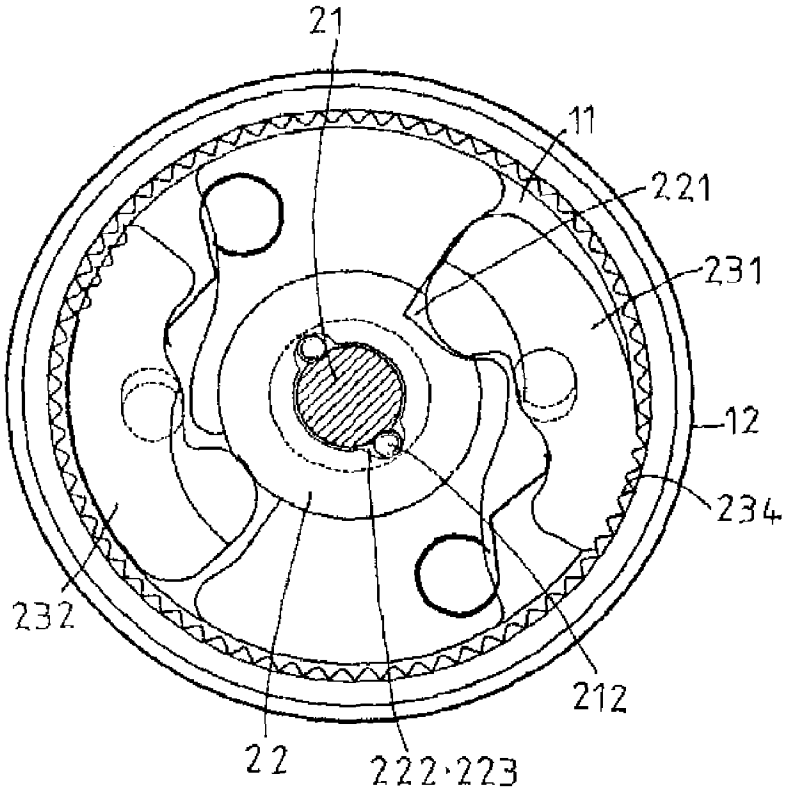
Figures 1, 5:
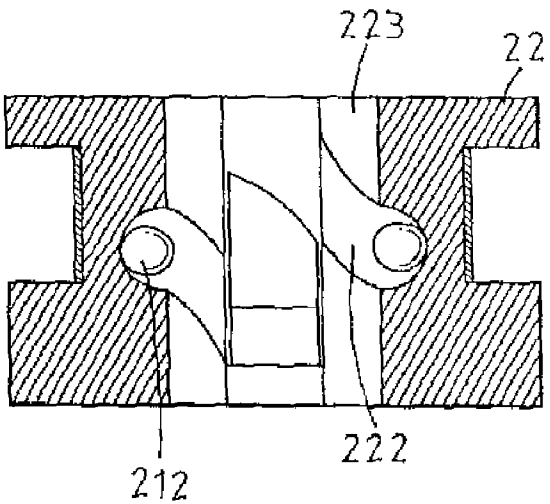
Figure 5:
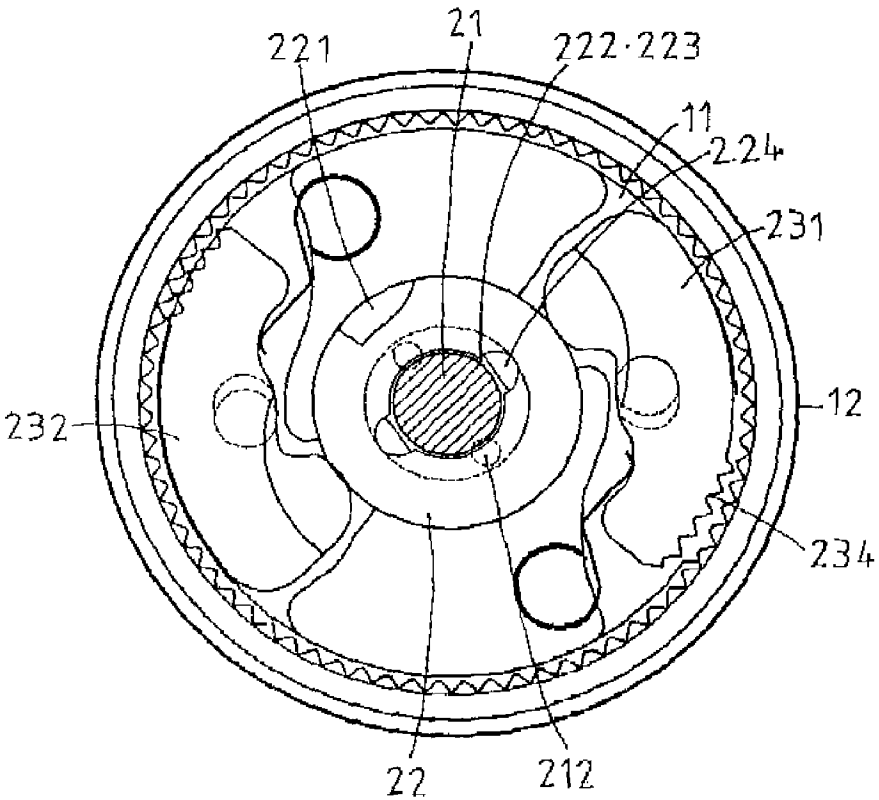

Referring to FIGS. 4 to 6, applications of the present invention are illustrated.

In FIG. 4, when the recess 221 is aligned to the buckle teeth block 231, the buckle teeth block 231 is pushed by the elastic unit 235 and thus to be engaged to the ratchet teeth portion 12. Then the driving portion of the tool rotates counterclockwise. The rear end of the buckle teeth block 231 resists against the seat 11 and thus the buckle teeth block 231 can not further move backwards. The driving head of the tool can be used to drive a screw unit. On the contrary, when driving head will rotate clockwise, the buckle teeth block 231 can move backwards toward the elastic unit 235 so that the driving head of the tool can restore clockwise.

If the user desires to change the restore direction of the driving head of the tool, the user can press the control rod 21 so that the interaction units 212 of the control rod 21 move vertically with the control rod 21. In this process, the driving block 22 moves. Referring to FIGS. 4-1 to 6-1, since the interaction units 212 of the control rod 21 enter into the connections of the trenches 222 and the stand grooves 223 of the driving block 22, the driving block 22 is limited by the first inclined surfaces 2241 of the check blocks 224 and thus it only falls down along inclined trenches 222. The interaction units 212 can not rotate because they are firmly secured to the control rod 21. The driving block 22 will rotate by the driving of the interaction units 212 until the interaction units 212 are at the lower connections of the inclined cambered trenches 222 and the stand grooves 223. As a result, the driving block 22 rotates through 180 degrees since the interaction units 212 move along the inclined cambered trenches 222. In FIG. 5-1, it is illustrated that the driving block 22 rotates through 90 degrees from the position illustrated in FIG. 4-1. In FIG. 6-1, it is illustrated that the driving block 22 rotates through 180 degrees from the position illustrated in FIG. 4-1. Thus the recess 221 of the driving block 22 rotates from the position illustrated in FIG. 4-1 to the position illustrated in FIG. 6-1 with an angle difference of 180 degrees so as to be aligned to another buckle teeth block 232. Therefore, the buckle teeth block 232 is pushed by the elastic unit 235 to shift to be engaged to the ratchet teeth portion 12. Then the driving head to be rotated clockwise, a rear end of the buckle teeth block 232 resists against the seat 11 so that it has no space to move backwards. The driving head can drive a screw unit. On the contrary, if it is desired to drive the driving head counterclockwise, the buckle teeth block 232 can retract toward the elastic unit 235 so that the driving head can restore counterclockwise.

Moreover, when the user desires to release the control rod 21, the elastic body 215 serves to push the control rod 21 out of the original position. The interaction units 212 will move upwards with the control rod 21. Then, the interaction units 212 are limited by the second inclined surfaces 2242 of the check blocks 224 and thus only move along the stand grooves 223 to push out the check blocks 2242 slightly so as to move upwards. Therefore, the interaction units 212 restore to the positions in that the control rod 21 is not pressed and the driving block 22 is not driven to rotate.

In the present invention, by the control rod 21 of the control device, the restoring of the driving head can be controlled by simply pressing the control rod 21. Furthermore, in this embodiment, by pressing the control rod 21, the positioning and releasing of the positioning body 116 of the head end 115 can be performed. Thus the operation is convenient.

Referring to FIGS. 7 to 10, the second embodiment of the quick switching hand tool of the present invention is illustrated. In this embodiment, those identical to the above embodiment will not be further described herein. Only those different from above embodiment are described.

Other then the ratchet sleeve spanner used in the first embodiment, the present invention can be used to a ratchet spanner with a closed opening. In this embodiment, the head end 115 in the first embodiment is replaced by a driving opening 301 in the ratchet teeth portion 12. The outer cover 13 is engaged to the driving head. The recess 221 of the driving block 22 in the first embodiment is replaced by an ejecting rib 302. The positions of the pivotal shaft 223 of the buckle teeth blocks 231, 232 and the elastic units 235 are changed so that when no buckle teeth block is resisted, it is engaged to the ratchet teeth portion 12, when they are resisted by the ribs 302, they will shift to separate from the ratchet teeth portion 12.

Figure 10:
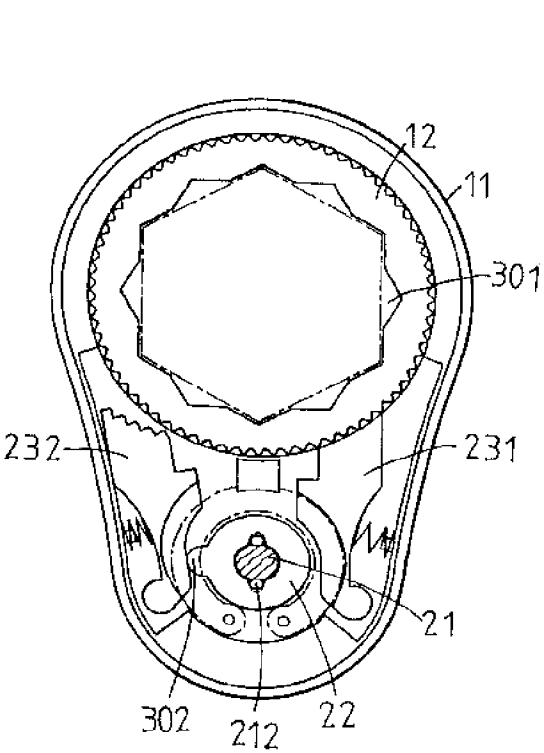
FIGS. 8 to 10 shows the second embodiment of the present invention.
Figure 9:
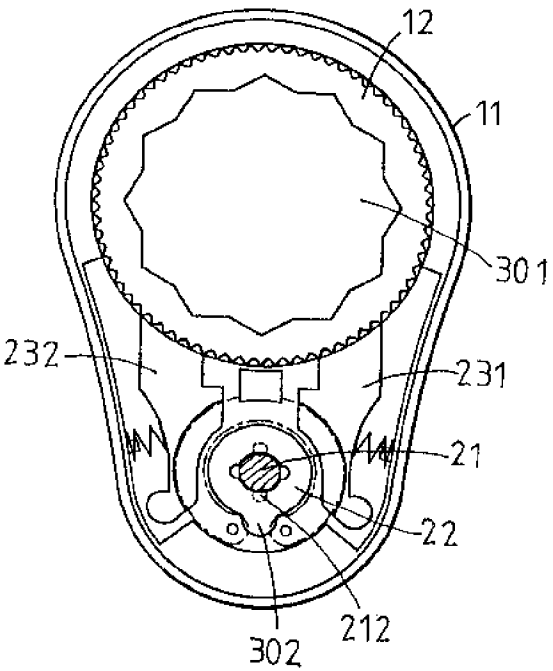

Thereby when the control rod 21 is pressed, the control rod 21 can drive the driving block 22 by the interaction units 212, as illustrated in FIGS. 8 to 10. Thus, the ejecting rib 302 of the driving block 22 moves to an opposite position so as to change the restoring direction of the driving head.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A quick switching hand tool comprising:

a driving head having a ratchet teeth portion; and a control device having a control rod; the control rod being installed with a driving block which is interacted with a buckle unit; the buckle unit having two buckle teeth blocks; each buckle teeth block being pivotally installed to the driving head and the buckle unit is engageable to the ratchet teeth portion; an outer end of the driving block having an resisting rib for controlling positions of the buckle teeth blocks; the control rod installed with at least one interaction unit and an inner surface of the driving block formed with at least one inclined cambered trench; the driving block installed to the control rod; and the interaction unit embedded into the inclined cambered trench; wherein the interaction unit moves along the inclined cambered trench to drive the driving block to rotate when the control rod is pressed so that the buckle unit shifts with the driving block to switch the restoring direction of the driving head.

2. The quick switching hand tool as claimed in claim 1, wherein an elastic unit is installed between each buckle teeth block and the driving head, when one buckle teeth block is aligned to the resisting rib of the driving block, the elastic unit will enforce the buckle teeth block to shift to be engaged to the ratchet portion.

3. The quick switching hand tool as claimed in claim 1, wherein the driving head has a seat which is engaged to the ratchet teeth portion; and the ratchet teeth portion is formed with a driving opening.

4. The quick switching hand tool as claimed in claim 1, wherein the driving block has two symmetrical inclined cambered trenches; upper ends of the two inclined cambered trenches are connected by a stand groove; and lower ends of the two inclined cambered trenches are connected by another stand groove.

5. The quick switching hand tool as claimed in claim 4, wherein each stand groove is installed with a check block and one end of each check block has a first inclined surface corresponding to the inclined cambered trench and another end thereof has a second inclined surface corresponding to the stand groove; and the driving block is engaged with an elastic unit out of the check block.

* * * * *